US009770379B1

(12) United States Patent
Schumaier

(10) Patent No.: US 9,770,379 B1
(45) Date of Patent: Sep. 26, 2017

(54) TANDEM CASKET SYSTEM WITH INTERCONNECTING PASSAGEWAY TO ACCOMMODATE HANDHOLDING OF DECEASED PERSONS

(71) Applicant: Daniel R. Schumaier, Elizabethton, TN (US)

(72) Inventor: Daniel R. Schumaier, Elizabethton, TN (US)

( * ) Notice: Subject to any disclaimer, the term of this patent is extended or adjusted under 35 U.S.C. 154(b) by 0 days.

(21) Appl. No.: 15/082,560

(22) Filed: Mar. 28, 2016

(51) Int. Cl.
*A61G 17/00* (2006.01)

(52) U.S. Cl.
CPC ..... *A61G 17/00* (2013.01)

(58) Field of Classification Search
CPC ..... A61G 17/00; A61G 17/04; A61G 17/044; E04H 13/00; E04H 13/005; E04H 13/006
USPC ..... 27/2, 19, 35; 52/131, 133, 134
See application file for complete search history.

(56) References Cited

U.S. PATENT DOCUMENTS

| | | | | |
|---|---|---|---|---|
| 371,626 | A | 10/1887 | Redl | |
| 500,013 | A | 6/1893 | Kwiatkowski | |
| 2,822,685 | A * | 2/1958 | Chandler | E04H 13/00 52/137 |
| 3,986,308 | A * | 10/1976 | Jones | E04H 13/006 52/134 |
| 2002/0050035 | A1 * | 5/2002 | Spicer | A61G 17/00 27/35 |

OTHER PUBLICATIONS

Using a rental casket for a cremation service; Cremation Blog; www.cremation.com/using-a-rental-casket-for-a-cremation-service; Oct. 4, 2013.

Propnomicon: Victorian Drop Side Casket; http://propnomicon.blogspot.com/2010/03/victorian-drop-side-casket; Mar. 15, 2010.

* cited by examiner

*Primary Examiner* — William Miller
(74) *Attorney, Agent, or Firm* — Luedeka Neely Group PC

(57) ABSTRACT

A tandem casket system includes two caskets disposed side by side. Interconnecting the two caskets is a passageway in which the hands of occupants of the caskets can be joined.

4 Claims, 4 Drawing Sheets

TANDEM CASKET SYSTEM WITH INTERCONNECTING PASSAGEWAY TO ACCOMMODATE HANDHOLDING OF DECEASED PERSONS

FIELD

This invention relates to the field of burial structures. More particularly, this invention relates to a tandem casket system having a passageway between adjacent caskets to allow a deceased person in one casket to hold hands with a deceased person in the other casket.

BACKGROUND

It is not uncommon for persons having close, life-long relationships to desire to be interred together when they die. Several options are available for interring deceased persons together in pairs or in groups, such as in family groups. For example, two-person caskets have been used in situations in which a couple, such as man and wife, died at the same time. Family burial vaults are also well known, which provide for multiple family members to be in a single vault, although typically in separate caskets. It is also not uncommon for spouses to be buried side-by-side in separate caskets. This is the typical situation for couples who die years apart.

One of the classic symbols of affection and togetherness is act of holding hands. Currently, there is no burial system that allows for deceased persons interred at different times to hold hands. The present invention addresses this need.

SUMMARY

The above and other needs are met by a tandem casket system that includes a first casket and a second casket. The first casket has an interior for receiving a body of a first deceased person. A first opening is provided through a side wall of the first casket into its interior. The second casket has an interior for receiving a body of a second deceased person. The second casket has a second opening through a side wall into its interior. A connecting passageway is disposed between and the first and second openings. According to a preferred embodiment, an appendage of the body of the first deceased person may pass through the first opening, and an appendage of the body of the second deceased person may pass through the second opening, so that the appendage of the first deceased person may contact the appendage of the second deceased person within the passageway.

In some embodiments, the passageway of the tandem casket system includes a first portal structure and a second portal structure. The first portal structure is attached to the side wall of the first casket and surrounds the first opening. The second portal structure is attached to the side wall of the second casket and surrounds the second opening. The first and second portal structures are operable to be attached together to provide a continuous connection between the interiors of the first and second caskets.

In some embodiments, the first portal structure includes an aperture in its upper surface that provides access to the interior of the passageway. The first portal structure also includes an access hatch that is operable to be moved from a closed position in which the access hatch covers the aperture to an open position in which the aperture is uncovered.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

Figure 2:
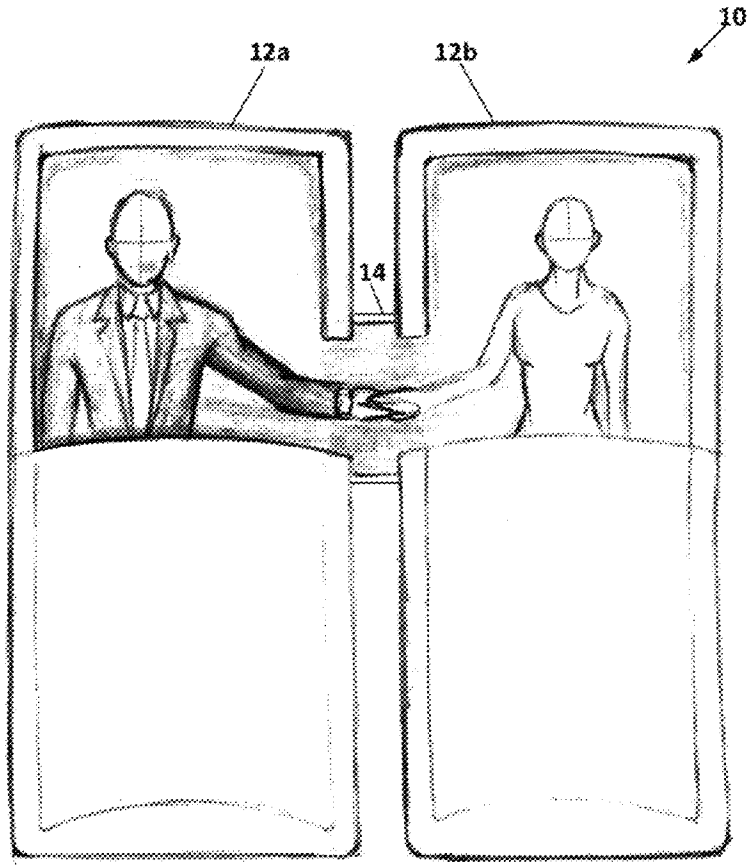
FIG. 2 is a top cutaway view of the tandem casket system of FIG. 1.
Figure 1:
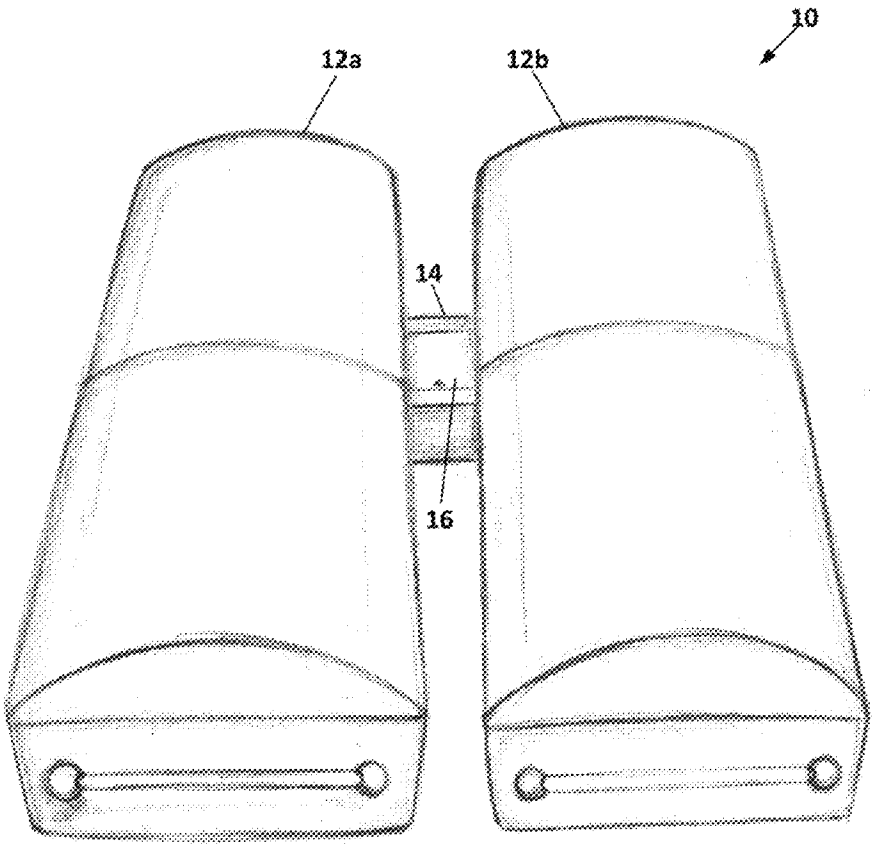
FIG. 1 is a perspective view of a tandem casket system having a passageway interconnecting two caskets that allows for joining the hands of the occupants of the two caskets according to an embodiment of the invention.

FIGS. 1 and 2 depict a tandem casket system 10 comprising two caskets 12*a* and 12*b* disposed side by side. Interconnecting the two caskets 12*a* and 12*b* is a passageway 14 in which the hands of occupants of the caskets can be joined, as shown in FIG. 2. In some embodiments, an access hatch 16 may be provided in the top of the passageway 14, as described in more detail hereinafter.

Figure 3:
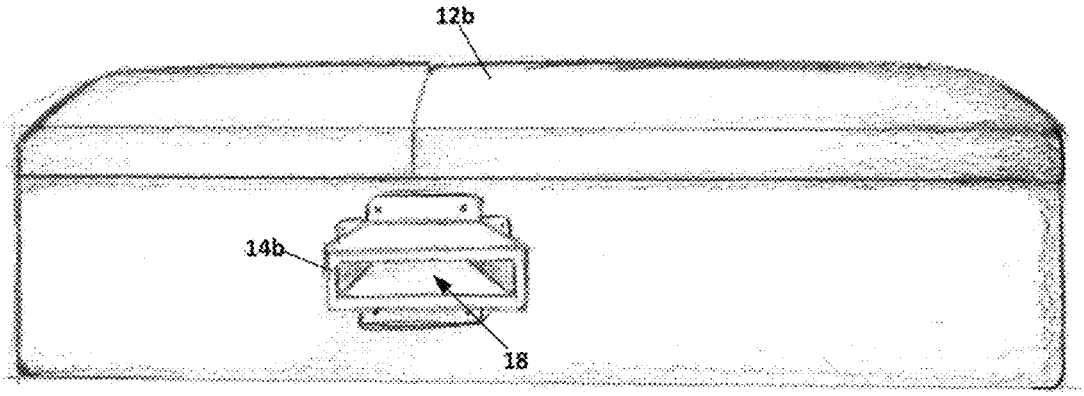
FIG. 3 is a side elevation view of one of the caskets of the tandem casket system of FIG. 1.
Figure 4:
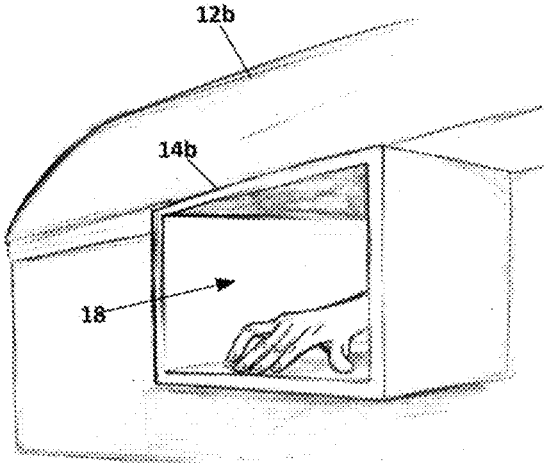
FIG. 4 is a perspective view depicting a first portal structure in the side of one of the caskets of the tandem casket system.
Figure 5:
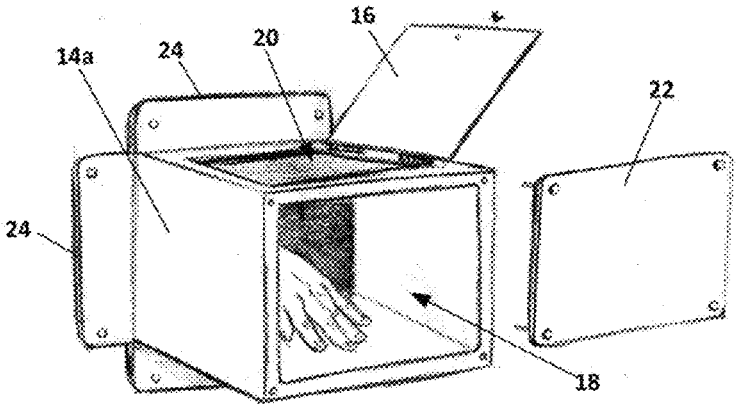
FIG. 5 is a perspective view depicting a second portal structure in the side of one of the caskets of the tandem casket system.

As shown in FIGS. 3, 4 and 5, the passageway of a preferred embodiment comprises a first portal structure 14*a* attached to the casket 12*a* and a second portal structure 14*b* attached to the casket 12*b*. Each of the portal structures 14*a*-14*b* provides an opening 18 into the interior 11*a*-11*b* of the casket 12*a*-12*b* to which it is attached. As shown in FIGS. 4 and 5, the hands of the two occupants of the caskets 12*a*-12*b* can be positioned in and rested upon the bottom surfaces of the portal structures 14*a*-14*b*.

The portal structures 14*a* and 14*b* can be connected together using various different means in various different embodiments. In one preferred embodiment, the opening 18 of the first portal structure 14*a* is large enough to accommodate the insertion of the second portal structure 14*b* into the first portal structure 14*a*. As shown in the cross-section view of FIG. 6, the two portal structures 14*a*-14*b* may be secured together by screws, bolts, or other fasteners 26 that pass through the walls of the first and second portal structures 14*a*-14*b*. In an alternative embodiment, the two portal structures 14*a*-14*b* are abutted together and connected by screws, bolts or other fasteners passing through end flanges in each structure. Those skilled in the art will appreciate there are many other ways to attach the two portal structures together to form the passageway 14.

Considering the fact that loved ones that are to be interred together usually do not die at the same time, preferred embodiments include means to seal the first portal structure 14*a* of the first casket 12*a* in which the first deceased person is interred until such time that it is to be joined to the second portal structure 14*b* of the second casket 12*b* containing the second deceased person. As shown in FIG. 5, the opening 18 into the first portal structure 14*a* may be sealed by a cover 22 that is attached to the end of the first portal structure 14*a*, such as using screws or other fasteners. This cover 22 is removed during the process of attaching the second portal structure 14*b* to the first portal structure 14*a*.

Figure 6:
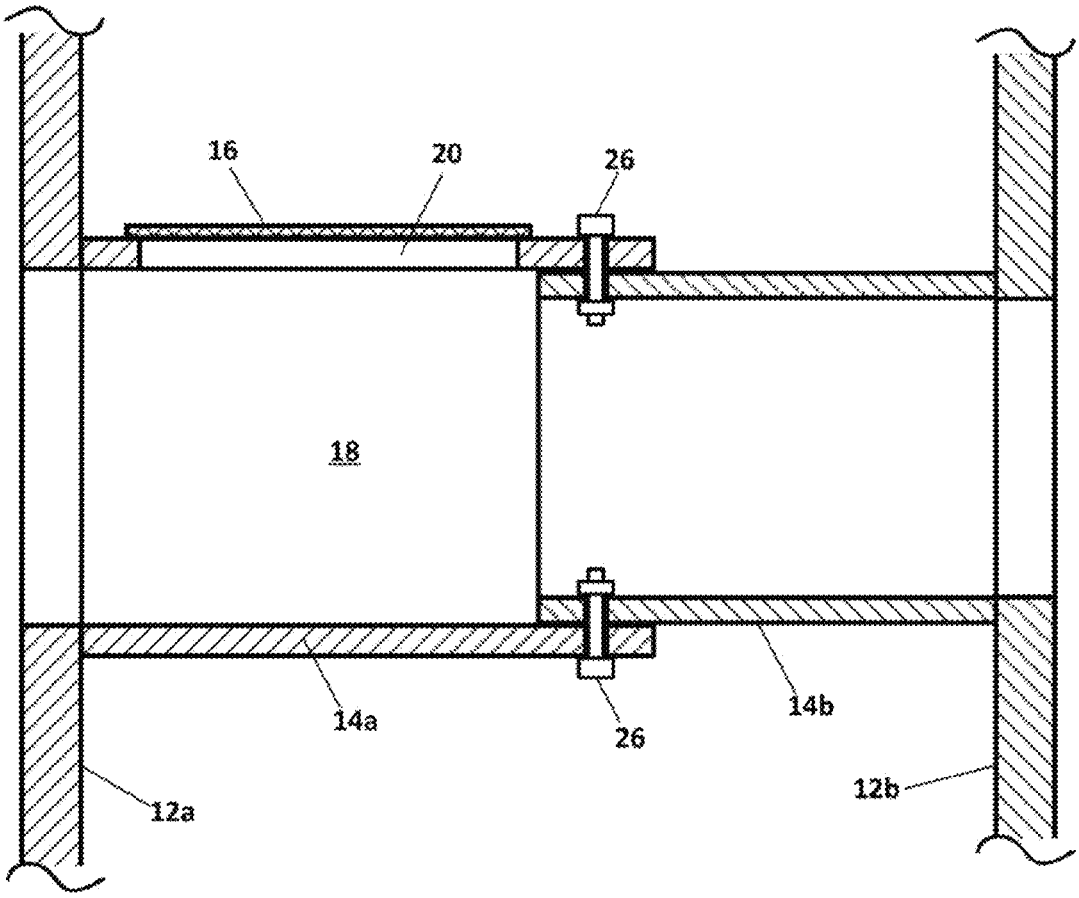
FIG. 6 is a vertical cross-section view depicting a connection of the first portal structure to the second portal structure according to an embodiment of the invention.

To provide access to the opening 18 after the first and second portal structures 14*a*-14*b* have been joined together, an access hatch 16 may be opened to uncover an aperture 20 through the upper surface of the first portal structure 14*a*. The aperture 20 is preferably large enough to allow someone to reach through the first portal structure 14*a* and into the second portal structure 14*b* to join the hands of the two deceased persons. In configurations in which the two portal structures 14*a*-14*b* are joined together using fasteners, the opening 20 also provides access into the interior of the first portal structure 14*a* to accommodate tools needed to secure bolts or other fasteners through the adjoining walls as shown in FIG. 6.

In some embodiments, such as depicted in FIGS. 3 and 5, the portal structures 14*a*-14*b* have flanges 24 that provide for attachment of the portal structures 14*a*-14*b* to the caskets 12*a*-12*b*, such as using screws or rivets. In alternative embodiments, the portal structures 14*a*-14*b* are formed integrally with the sidewalls of the caskets 12*a*-12*b*, as shown in FIG. 4.

Figure 7B:
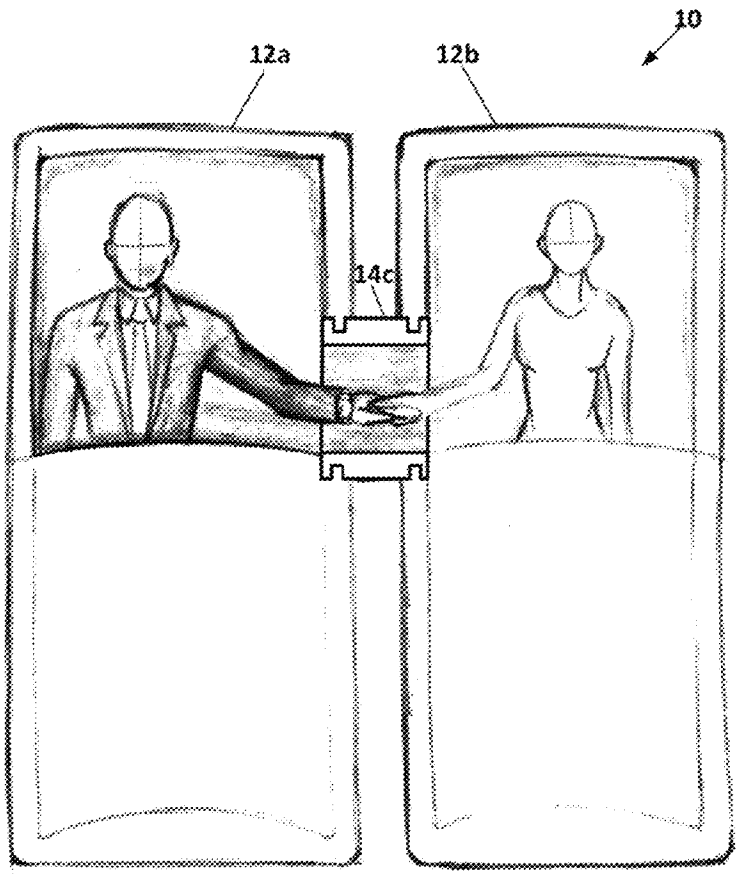
FIGS. 7A and 7B are top cutaway views of an alternative embodiment of the tandem casket system.
Figure 7A:
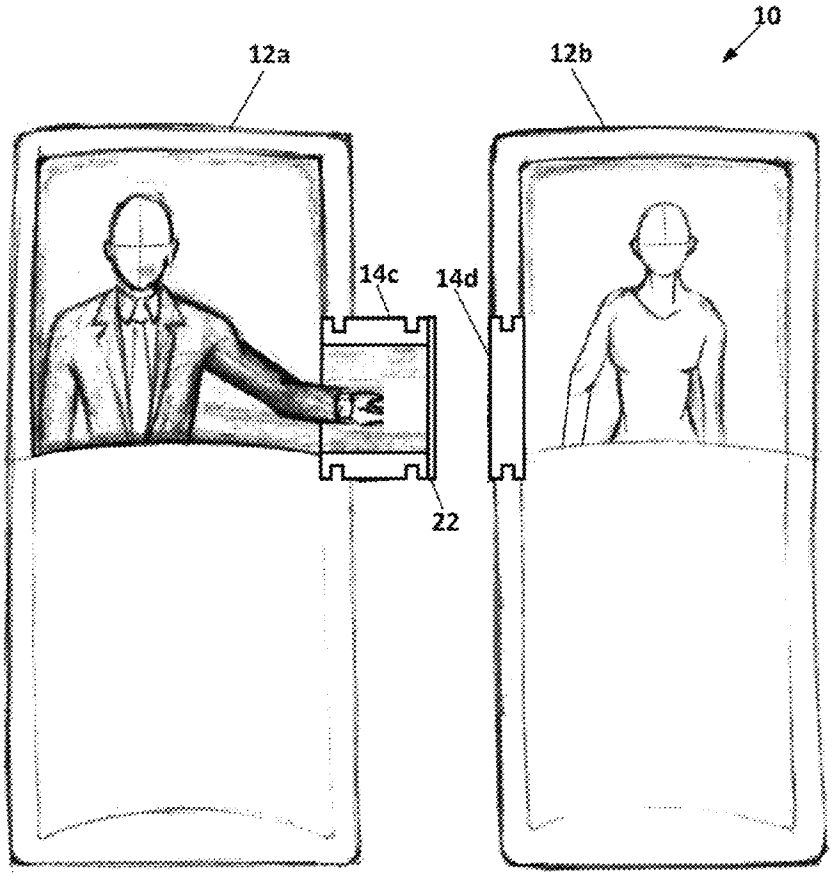

With reference to FIGS. 7A and 7B, an alternative embodiment of the passageway 14 comprises a movable portal structure 14*c* having a tongue-and-groove type structure that is operable to slide down into vertical openings in the sidewalls of the caskets 12*a*-12*b*. This embodiment also includes a temporary closure panel 14*d* having the same sort of tongue-and-groove structure. With this embodiment, the person who dies first is interred in the casket 12*a* having the movable portal structure 14*c* and cover 22 in place, as depicted in FIG. 7A. (Not shown in FIG. 7A is the top of the portal structure 14*c*, which may be a hinged access hatch as depicted in FIGS. 5 and 6.) When it is time for the second deceased person to be interred, (1) the upper portion of the structure 14*c* is removed by sliding it upwards out of the opening in the casket 12*a*, and the cover 22 is removed, (2) the casket 12*b* (with the temporary closure panel 14*d* removed) is positioned adjacent the casket 12*a* at the correct spacing, (3) the portal structure 14*c* is put in place by engaging the tongue-in-groove features and sliding it downward into the vertical openings in the sidewalls of the caskets 12*a*-12*b*, (4) the hands of the deceased persons may then be joined within the passageway as shown in FIG. 7B, and (5) a cover (similar to the access hatch 16) is put in place to cover the passageway.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A tandem casket system comprising:

a first casket having an interior for receiving a body of a first deceased person, the first casket having a first opening through a side wall into the interior of the first casket;

a second casket having an interior for receiving a body of a second deceased person, the second casket having a second opening through a side wall into the interior of the second casket; and a passageway disposed between and connecting the first opening and the second opening, wherein an appendage of the body of the first deceased person may pass through the first opening, wherein an appendage of the body of the second deceased person may pass through the second opening, and wherein the appendage of the body of the first deceased person may contact the appendage of the body of the second deceased person within the passageway.

2. The tandem casket system of claim 1 wherein the passageway comprises:

a first portal structure attached to the side wall of the first casket, the first portal structure surrounding the first opening; and a second portal structure attached to the side wall of the second casket, the second portal structure surrounding the second opening, wherein the first and second portal structures are operable to be attached together to provide a continuous connection between the interiors of the first and second caskets.

3. The tandem casket system of claim 2 wherein the first portal structure comprises:

an aperture in an upper surface of the first portal structure, the aperture providing access to an interior of the first portal structure; and an access hatch that is operable to be moved from a closed position in which the access hatch covers the aperture to an open position in which the aperture is uncovered.

4. A tandem casket system comprising:

a first casket having an interior for receiving a body of a first deceased person, the first casket having a first opening through a side wall into the interior of the first casket;

a first portal structure attached to the side wall of the first casket, the first portal structure surrounding the first opening and providing a passageway into the interior of the first casket, the first portal structure comprising:

an aperture in an upper surface of the first portal structure, the aperture providing access into the passageway; and an access hatch that is operable to be moved from a closed position in which the access hatch covers the aperture to an open position in which the aperture is uncovered;

a second casket having an interior for receiving a body of a second deceased person, the second casket having a second opening through a side wall into the interior of the second casket; and a second portal structure attached to the side wall of the second casket, the second portal structure surrounding the second opening, wherein the first and second portal structures are operable to be attached together to extend the passageway from the interior of the first casket to the interior of the second casket.

* * * * *